US009268264B2

(12) United States Patent
Saito

(10) Patent No.: US 9,268,264 B2
(45) Date of Patent: Feb. 23, 2016

(54) IMAGE FORMING APPARATUS WITH LUBRICATION SUPPLY

(75) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 510 days.

(21) Appl. No.: 13/469,561

(22) Filed: May 11, 2012

(65) Prior Publication Data

US 2012/0315071 A1 Dec. 13, 2012

(30) Foreign Application Priority Data

Jun. 10, 2011 (JP) ..... 2011-130261

(51) Int. Cl.
*G03G 15/16* (2006.01)
*G03G 15/01* (2006.01)

(52) U.S. Cl.
CPC ..... *G03G 15/161* (2013.01); *G03G 15/0189* (2013.01); *G03G 2215/0129* (2013.01)

(58) Field of Classification Search
CPC ..... G03G 15/161
USPC ..... 399/346
See application file for complete search history.

(56) References Cited

U.S. PATENT DOCUMENTS 6,363,237 B1 * 3/2002 Nagame et al. ..... 399/343
2004/0091276 A1 * 5/2004 Yoshida et al. ..... 399/38
2005/0254853 A1 11/2005 Yoshida
2006/0045579 A1 * 3/2006 Ozawa et al. ..... 399/302
2009/0052959 A1 * 2/2009 Tomoe ..... 399/346
2011/0064433 A1 * 3/2011 Asaoka et al. ..... 399/46

FOREIGN PATENT DOCUMENTS

JP 55029867 A * 3/1980 ..... G03G 15/00
JP 2004-053942 A 2/2004
JP 2005-321577 A 11/2005
JP 2006-343623 A 12/2006
JP 2007-241114 A 9/2007
JP 2008-015406 A 1/2008
JP 2010-169937 A 8/2010
JP 2011-007848 A 1/2011

OTHER PUBLICATIONS

Nagame et al. Translation of Abstract of JP55029867. Published Mar. 3, 1980. Translated Nov. 24, 2014.*
Office Action dated Apr. 21, 2015, in Japanese Patent Application No. 2011-130261.
Office Action dated Nov. 3, 2014, in Chinese Patent Application No. 201210183812.5.

* cited by examiner

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

A mode is executed so that a lubricant applying member is rotated based on an image formation start signal, and thereafter a rotation drive of an image bearing member is started.

4 Claims, 4 Drawing Sheets

IMAGE FORMING APPARATUS WITH LUBRICATION SUPPLY

BACKGROUND OF THE INVENTION

1. Field of the Invention

The present invention relates to an image forming apparatus, such as a copying machine and a printer, which uses an electrophotographic method or an electrostatic recording method, and more particularly, to an image forming apparatus including a cleaning blade.

2. Description of the Related Art

Conventionally, for example, in an electrophotographic image forming apparatus, an electrostatic image (latent image) formed on an electrophotographic photosensitive member (photosensitive member) is developed with toner to form a toner image. Then, the toner image formed on the photosensitive member is ultimately transferred onto a recording material (recording sheet, OHP sheet, etc.) to be fixed thereto and output from the image forming apparatus. Examples of a method of transferring a toner image formed on a photosensitive member onto a recording material include: a direct transfer method of directly transferring a toner image formed on a photosensitive member onto a recording material; and an intermediate transfer method of transferring a toner image formed on a photosensitive member onto an intermediate transfer member once and then transferring the toner image transferred on the intermediate transfer member onto a recording material.

When the above-mentioned photosensitive member or an image bearing member such as an intermediate transfer member once holds a toner image and then transfers the toner image onto a transfer target member, toner remains on the surface of the photosensitive member or the image bearing member without being transferred. Therefore, it is necessary to clean the surface so as to form a subsequent image. Conventionally, a cleaning blade method of removing remaining toner by bringing a cleaning blade into abutting contact with the surface of the image bearing member has been widely adopted.

If a friction force between the cleaning blade and the image bearing member is too large when the cleaning blade is brought into abutting contact with the surface of the image bearing member, an abutment portion of the cleaning blade may be turned up, resulting in blade turning up. Further, even when the blade turning up does not occur, the surface of the image bearing member may be scraped or scratched to cause an image defect. In order to prevent this problem, a technology has been proposed, which prevents the blade from being turned up or the image bearing member from being scratched as described above by applying a lubricant to the image bearing member to lower a surface energy of the image bearing member and to reduce a friction force between the image bearing member and the cleaning blade (Japanese Patent Application Laid-Open No. 2007-241114).

However, in an application of lubricant to the image bearing member, when the rotation of the image bearing member is suspended, a state in which the lubricant is applied to a region of the image bearing member from a contact portion between the image bearing member and a lubricant applying unit to a cleaning blade nip portion is left as it is.

At this time, particularly, the lubricant sandwiched between the lubricant applying unit and the image bearing member is pressurized against the image bearing member. Therefore, the lubricant may adhere to the image bearing member. The lubricant adhering to the image bearing member does not function as a lubricant with respect to the cleaning blade, and when the lubricant enters the nip portion between the cleaning blade and the image bearing member, the lubricant rather causes the cleaning blade to be turned up or chipped and the surface of the image bearing member to be scratched.

SUMMARY OF THE INVENTION

The present invention provides an image forming apparatus which prevents a lubricant from adhering to an image bearing member so as to prevent a cleaning blade from being turned up or chipped and the surface of the image bearing member from being scratched.

An image forming apparatus, including: a rotatable image bearing member; a blade member which is in abutting contact with the image bearing member and removes a remaining toner remaining on the image bearing member; a rotary member which is rotatably provided in contact with the image bearing member on an upstream side with respect to the blade member in a rotation direction of the image bearing member; a lubricating member which is brought into abutting contact with the rotary member to supply a lubricant to the rotary member; a drive device configured to provide a drive to the image bearing member and the rotary member; and an execution portion configured to execute a mode of controlling the drive of the drive device to rotate the rotary member based on an image formation start signal before the image bearing member is rotated.

Further features of the present invention will become apparent from the following description of exemplary embodiments with reference to the attached drawings.

DESCRIPTION OF THE EMBODIMENTS

First Embodiment

Hereinafter, an image forming apparatus according to the present invention will be described in detail with reference to the drawings.

(Entire Configuration of an Image Forming Apparatus)

Figure 1:
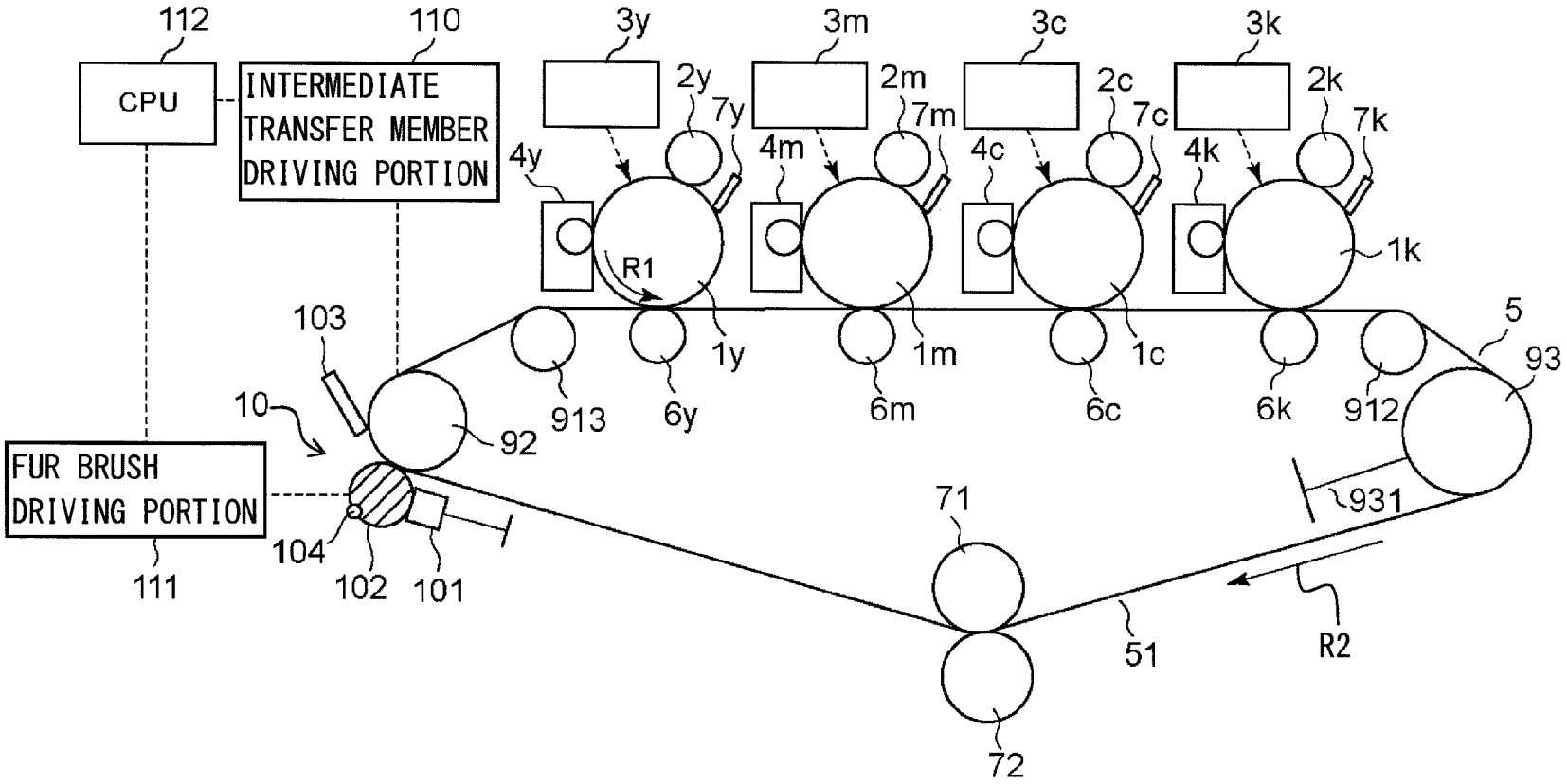
FIG. 1 is a schematic cross-sectional structural view of an image forming apparatus according to a first embodiment of the present invention.

FIG. 1 illustrates a schematic cross-sectional configuration of an image forming apparatus according to a first embodiment of the present invention. The image forming apparatus of this embodiment is a laser beam printer which forms a full-color image on a recording material (recording sheet, OHP sheet, cloth, etc.) through use of an electrophotographic method.

The image forming apparatus includes first, second, third, and fourth image forming portions (stations) which form yellow, magenta, cyan, and black images, respectively, as image forming units configured to form toner images.

In this embodiment, the configuration of each image forming portion is the same except for the color of toner to be used.

Therefore, hereinafter, in the case where distinction thereof is not particularly required, suffix letters of y, m, c, and k attached to numerical numbers so as to indicate what color the elements are provided for are omitted, and description is made collectively.

The image forming portion is provided with a cylindrical photosensitive member as an image bearing member, that is, a photosensitive drum 1. A charging roller 2 as a charging unit and a laser beam scanner 3 as an exposure unit are arranged around the photosensitive drum 1. Further, a developing device 4 as a developing unit and a photosensitive member cleaning device 7 as a cleaning unit are arranged around the photosensitive drum 1. Further, an intermediate transfer unit 5 is arranged so as to be opposed to the photosensitive drum 1 of each image forming portion.

The intermediate transfer unit 5 includes, as an image bearing member, an intermediate transfer belt 51 that is an intermediate transfer member. The intermediate transfer belt 51 is passed over a drive roller 92, a secondary transfer inner roller (inner roller) 71, and two idler rollers 912, 913 as a plurality of support members so as to be rotated. When a drive force is transmitted to the drive roller 92, the intermediate transfer belt 51 is moved (rotated) in circle in a direction indicated by an arrow R2 in FIG. 1.

On the inner circumferential surface side of the intermediate transfer belt 51, primary transfer rollers (electrode members) 6 as primary transfer units are arranged at positions opposed to the photosensitive drums 1*y*, 1*m*, 1*c*, and 1*k* of the respective image forming portions. When the primary transfer rollers 6*y*, 6*m*, 6*c*, and 6*k* press the intermediate transfer belt 51 against the photosensitive drums 1*y* to 1*k*, a primary transfer portion (primary transfer nip) is formed, at which the intermediate transfer belt 51 comes into contact with the photosensitive drum 1.

Further, a secondary transfer outer roller (outer roller) 72 is arranged at a position opposed to the inner roller 71 via the intermediate transfer belt 51. The intermediate transfer belt 51 is sandwiched between the inner roller 71 and the outer roller 72 forming a secondary transfer unit, and the inner roller (electrode member) 71 is brought into contact with the inner circumference of the intermediate transfer belt 51 and the outer roller 72 is brought into contact with the outer circumference of the intermediate transfer belt 51.

The photosensitive drum 1 is driven to be rotated at a predetermined circumferential speed (process speed) in a direction (counterclockwise direction) indicated by an arrow R1 in FIG. 1. The circumferential surface of the photosensitive drum 1 is charged (primarily charged) to a predetermined polarity and potential by the charging roller 2 that is a contact charging member.

The laser beam scanner 3 outputs laser light that is on/off modulated in accordance with image information input from external equipment such as an image scanner or a computer. The laser beam scanner 3 scans the charged surface of the photosensitive drum 1 and exposes the surface to the laser light. An electrostatic image (latent image) is formed on the photosensitive drum 1 in accordance with intended image information through scanning and light exposure by the laser beam scanner 3.

The electrostatic image formed on the photosensitive drum 1 is visualized as a toner image by the developing device 4. In this embodiment, the developing device 4 contains, as a developer, a two-component developer containing non-magnetic toner and a magnetic carrier (carrier). The developing device 4 includes a developing sleeve as a developer carrying member arranged so as to be opposed to the photosensitive drum 1. Then, toner is supplied from a magnetic brush of the developer carried on the developing sleeve to the photosensitive drum 1 in a development region, and thus the electrostatic image on the photosensitive drum 1 is developed to become a toner image.

The toner image formed on the photosensitive drum 1 is electrostatically transferred (primarily transferred) onto the intermediate transfer belt 51 by the primary transfer roller 6. At this time, a primary transfer bias is output from a primary transfer bias power source that is a primary transfer bias output unit and applied to the primary transfer roller 6 as a bias applying member. The primary transfer bias of +900 V is used in this embodiment.

The remaining toner (remaining toner after primary transfer) remaining on the photosensitive drum 1 after the primary transfer is collected by the photosensitive member cleaning device 7. Consequently, the remaining toner is removed from the image bearing member so that the image bearing member is used again for the subsequent image formation. Further, the photosensitive member cleaning device 7 includes a blade member made of urethane with a thickness of 2 μm.

For example, at a time of formation of a full-color image, the above-mentioned operation is performed successively in the first to fourth image forming portions. Thus, in each primary transfer portion, a toner image of each color is transferred so as to be superimposed on the intermediate transfer belt 51.

Meanwhile, a recording material is conveyed to the secondary transfer portion from a recording material supply portion in synchronization with the toner image on the intermediate transfer belt 51. The recording material is supplied to the secondary transfer portion in timed relation to with the toner image on the intermediate transfer belt 51.

The toner image on the intermediate transfer belt is electrostatically transferred onto the recording material by an electric field between the inner roller 71 and the outer roller 72 in the secondary transfer portion. An electric field can be formed between the inner roller 71 and the outer roller 72 by applying a bias to any one of the rollers. A secondary transfer bias of 2.3 kV is used in this embodiment. However, an appropriate value may be set depending upon the device without any limitation.

The recording material with the toner image transferred thereon in the secondary transfer portion is conveyed to a fixing device through a conveying path (not shown), and the toner image on the recording material becomes a fixed image.

In this embodiment, as the intermediate transfer belt 51, a belt formed of a three-layered configuration including a base layer, an elastic layer, and a surface layer is used. As the base layer, a semi-conductive polyimide resin with a relative permittivity $\epsilon$ of 3 to 5, a volume resistivity $\rho v$ of $10^6$ to $10^{11}$ Ω·m, and a thickness of 85 μm is used. As the elastic layer, an urethane rubber layer with a volume resistivity $\rho v$ of $10^6$ to $10^{11}$ Ω·m and a thickness of 260 μm is used, and as the surface layer, an insulating PVDF resin with a thickness of 2 μm is used.

As the primary transfer roller 6, a semi-conductive roller with a resistance of $10^2$ to $10^8$Ω at the time of application of 2,000 V can be used. In this embodiment, as the primary transfer roller 6, an ion-conductive sponge roller with an outer diameter of 16 mm and a cored bar diameter of 8 mm, which is formed of a mixture of nitrile rubber and an ethylene-epichlorohydrin copolymer, is used. The resistance of the primary transfer roller 6 was about $10^6$ to $10^8$Ω (applied voltage: 2 kV) at a temperature of 23° C. and a humidity of 50%.

As the inner roller 71, a semi-conductive roller with an outer diameter of 20 mm and a cored bar diameter of 16 mm, in which conductive carbon is dispersed in EPDM rubber, is used. The resistance of the inner roller 71 is about 10 to $10^5\Omega$ (applied voltage: 10 V) at a temperature of 23° C. and a humidity of 50% by the measurement method similar to the above-mentioned method.

Further, as the outer roller 72, an ion-conductive sponge roller with an outer diameter of 24 mm and a cored bar diameter of 12 mm, which is formed of a mixture of nitrile rubber and an ethylene-epichlorohydrin copolymer, is used. The resistance of the outer roller 72 is about $10^6$ to $10^8\Omega$ (applied voltage: 2 kV) at a temperature of 23° C. and a humidity of 50% by the measurement method similar to the above-mentioned method.

The image forming apparatus of this embodiment includes, as an intermediate transfer member cleaning device 10 that is a cleaning device for the intermediate transfer belt 51, a cleaning blade 103, a lubricating member 101 which supplies a lubricant, a lubricant applying unit 102 as a rotary member, and a cleaning member 104 which removes a lubricant on the lubricant applying unit 102. The intermediate transfer member cleaning device 10 may include a cleaning blade, and the lubricant applying unit and the like may be provided separately.

In this embodiment, a blade member made of urethane with a thickness of 2 μm is used as the cleaning blade 103. The cleaning blade 103 is attached to a support sheet metal (not shown) and has a free length of 8 mm as a region not attached to the support sheet metal. Further, the cleaning blade 103 is pressed against the intermediate transfer belt 51 by a pressure mechanism (not shown), and a pressure force is set to be 1.1 kgf. Further, the cleaning blade 103 is brought into abutting contact with the intermediate transfer belt 51 at an angle of 17° with respect to a tangent of the intermediate transfer belt 51 at a contact point between the intermediate transfer belt 51 and the blade 103.

In this embodiment, solid zinc stearate is used as the lubricating member 101. As a lubricant supplied from the lubricating member 101, a fatty acid metallic salt can be used. As the fatty acid, stearic acid, palmitic acid, myristic acid, oleic acid, or the like is used. As the metallic salt, zinc, iron, aluminum, lead, magnesium, calcium, or the like can be used.

Further, as the lubricant applying unit 102, a fur brush is used. In this embodiment, a fur brush with a fur length of 5 mm and a fur thickness of 6.25 deniers is used. The cored bar diameter is set to 8 mm. The fur brush 102 is arranged at a position opposed to the intermediate transfer belt drive roller 92 with respect to the intermediate transfer belt 51 in a state in which a distance between shafts of the drive roller 92 and the fur brush 102 is fixed, and arranged with a fixed inroad amount of 1 mm by which the fur brush 102 makes inroads into the intermediate transfer belt 51. Further, the fur brush 102 is arranged so as to come into contact with the intermediate transfer belt 51 on an upstream side with respect to the cleaning blade 103 in the rotation direction of the intermediate transfer belt 51, and comes into contact with the lubricant and rotates, thereby applying the lubricant to the intermediate transfer belt 51.

In this embodiment, the solid zinc stearate as the lubricating member 101 is pressurized against the fur brush 102 by a pressure mechanism (not shown). In this embodiment, the lubricating member 101 is pressed against the fur brush 102 with a predetermined pressure force of 0.4 kgf.

The solid zinc stearate as the lubricating member 101 is reduced in size by being consumed. Therefore, if the lubricating member 101 is not continued to be pressed against the fur brush 102 at a predetermined pressure force, the lubricating member 101 cannot come into contact with the fur brush 102. Therefore, the pressure force is fixed.

Meanwhile, the fur brush 102 is brought into contact with the intermediate transfer belt 51 with the fixed inroad amount for the following reason. In a case where the pressure force of the fur brush 102 against the image bearing member is fixed, the pressure force may become unstable because the fur brush 102 presses the intermediate transfer belt 51 while being pressed by the solid zinc stearate. Therefore, in this embodiment, the fur brush 102 is arranged with the fixed inroad amount with respect to the intermediate transfer belt 51. Note that, the pressure force of the fur brush 102 against the image bearing member may be fixed.

The fur brush 102 that is the lubricant applying unit receives a drive transmitted from a fur brush driving portion 111 that is a second drive unit and rotates forwardly at the abutment portion with respect to the movement direction of the intermediate transfer belt 51. Further, the fur brush 102 is driven so as to rotate at a circumferential speed slower than the running speed of the intermediate transfer belt 51, and in this embodiment, the circumferential speed of the fur brush 102 is set to 104 mm/sec with respect to the running speed of 348 mm/sec of the intermediate transfer belt 51. On the other hand, the intermediate transfer belt 51 receives a drive transmitted from an intermediate transfer member driving portion 110 that is a first drive unit and rotates in a direction indicated by an arrow in FIG. 1. The drive timing and the rotation speed of the intermediate transfer member driving portion 110 and the fur brush driving portion 111 are controlled by a CPU 112 that is a control unit. This will be described later in detail.

In this embodiment, the fur brush 102 receives a drive from the fur brush driving portion 111 that is the second drive unit so as to be rotated while being pressed by the solid zinc stearate that is a lubricant. At this time, zinc stearate is scraped with the tip end of the fur brush 102 and a small amount of zinc stearate is held by the tip end of the fur brush 102. Then, the fur brush 102 rotates to apply zinc stearate held by the tip end of the fur brush 102 to the surface of the intermediate transfer belt 51. In this embodiment, as the fur brush 102, fibers of 6.25 deniers are used, and the thickness of the tip end of the fur brush 102 is about 30 microns.

When the diameter of the solid zinc stearate held by the tip end of the fur brush 102 is below 5 microns, zinc stearate may pass through the abutment portion between the cleaning blade 103 and the intermediate transfer belt 51. At this time, zinc stearate moves while adhering to the intermediate transfer belt 51 and contaminates the contact member such as the charging roller 2 around the photosensitive drum 1 to cause an image streak. Considering this, it is desired that the thickness of the tip end of the fur brush 102 be 15 microns or more.

On the other hand, when the thickness of the fur brush 102 exceeds 40 microns, the fiber stiffness increases. Therefore, the fur brush 102 remains falling over at a site where the fur brush 102 is brought into abutting contact with the pressurized solid zinc stearate, without returning to its original form, and there is a possibility that the fur flattening (crush-down) may occur. When the fur flattening occurs partially in the fur brush 102, an uneven applying amount of zinc stearate with respect to the intermediate transfer belt 51 may occur because the inroad amount of the fur brush 102 with respect to the intermediate transfer belt 51 decreases locally.

Further, the uneven inroad amount of the fur brush 102 with respect to the intermediate transfer belt 51 causes a fluctuation in a drive torque of the intermediate transfer belt 51. Therefore, image unevenness such as banding to be caused by a load fluctuation of the intermediate transfer belt 51 may be caused. For the above-mentioned reason, it is desired to use a brush with a fiber thickness of 15 to 40 microns as the fur brush 102. Note that, the fiber thickness of the fur brush 102 is not limited to the above-mentioned range.

Figure 2:
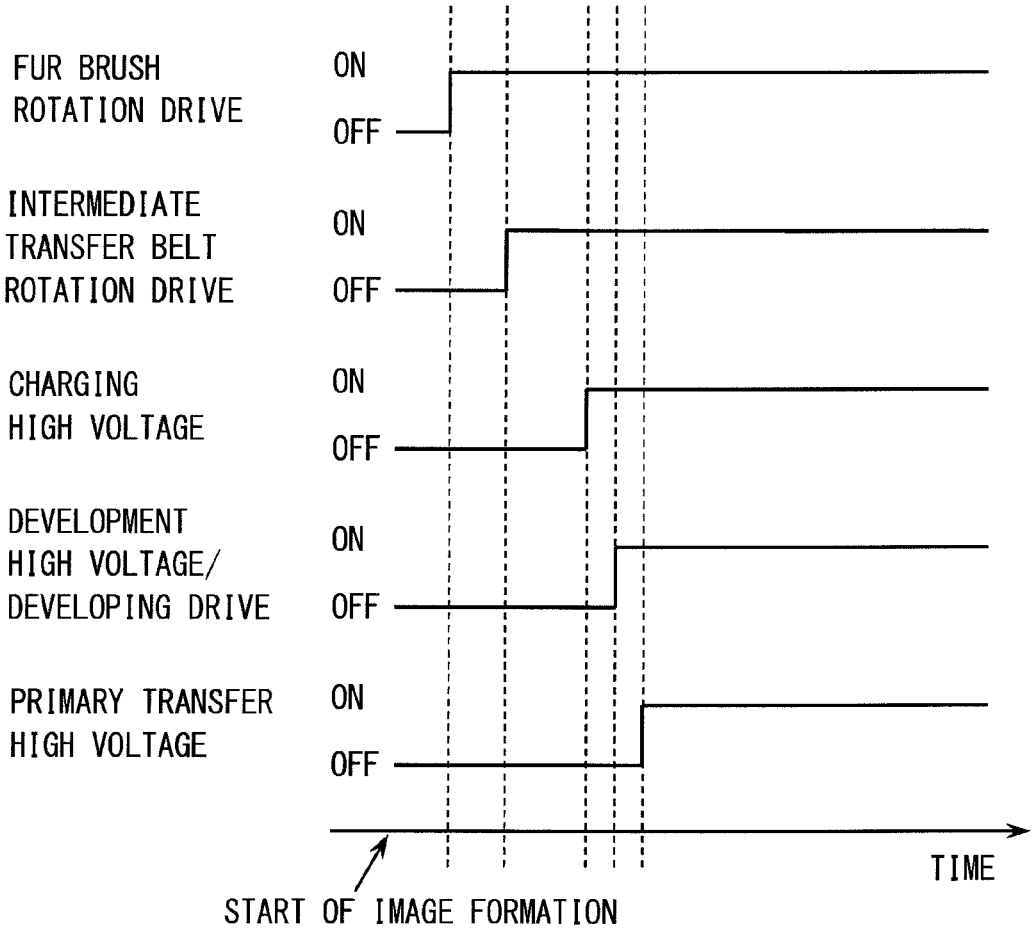
FIG. 2 is a drive timing chart of a fur brush at the start of image formation according to the first embodiment.

FIG. 2 illustrates a timing chart at the start of image formation, which is a feature of this embodiment. Specifically, the feature of the present invention is that, at the start of image formation, the fur brush 102 that is the lubricant applying unit is driven to rotate, and then, the intermediate transfer member for applying a lubricant is driven to rotate. In FIG. 2, the above-mentioned control is performed at a timing when an image signal is input to end a standby state and image formation is started. Note that, the present invention may be applied at a timing when a power source is turned on and image formation is started.

As illustrated in FIG. 2, when an image formation signal is input to end the standby state and the image formation is started, the fur brush driving portion 111 configured to drive the fur brush 102 that is the lubricant applying unit is turned on. After a predetermined period of time after turning on the fur brush driving portion 111, the intermediate transfer member driving portion 110 configured to drive the intermediate transfer belt 51 as an image bearing member to which a lubricant is applied is turned on. When the intermediate transfer member driving portion 110 is turned on after a predetermined period of time from the time when the fur brush driving portion 111 is turned on, the fur brush 102 can scrape zinc stearate remaining at the contact portion (nip portion) between the fur brush 102 and the intermediate transfer member belt 51 during the standby state without allowing zinc stearate to adhere to the intermediate transfer belt 51. Further, a charging high voltage, a development high voltage/developing drive, and a primary transfer high voltage are turned on after turning on the intermediate transfer member driving portion 110, thereby forming a toner image and outputting the image to a recording material.

During the standby state or the like, in which both of the intermediate transfer belt 51 and the fur brush 102 are not rotating, zinc stearate is left while the lubricant is applied to a region from the contact portion between the fur brush 102 and the intermediate transfer belt 51 to the cleaning blade nip portion.

At this time, in particular, zinc stearate in the contact portion (nip portion) sandwiched between the fur brush 102 and the intermediate transfer belt 51 is left while being pressurized against the intermediate transfer belt 51. Therefore, if the intermediate transfer belt 51 is driven as it is, there is a possibility that zinc stearate may be supplied to the nip portion of the cleaning blade 103 while adhering to the intermediate transfer belt 51.

Zinc stearate adhering to the intermediate transfer belt 51 does not function as a lubricant with respect to the cleaning blade 103. When the zinc stearate enters the nip portion between the cleaning blade 103 and the image bearing member, zinc stearate may rather cause the cleaning blade 103 to be turned up or chipped and the surface of the image bearing member to be scratched. When a drive timing of the fur brush 102 is set ahead of that of the intermediate transfer belt 51 as described above, the fur brush 102 is driven while the intermediate transfer belt 51 is not moving (rotating), and hence the fur brush 102 can scrape zinc stearate at the contact portion (nip portion) between the intermediate transfer belt 51 and the fur brush 102 without allowing zinc stearate to adhere to the intermediate transfer belt 51. That is, a lubricant is prevented from adhering to the intermediate transfer belt 51, thereby preventing the cleaning blade 103 from being turned up or chipped and the surface of the intermediate transfer belt 51 from being scratched.

The rotation speed of the fur brush 102 may be switched between a period before the rotation drive of the image bearing member and a period after the rotation drive thereof. Before the rotation drive of the image bearing member, the fur brush 102 may be rotated at a speed higher than 104 mm/sec, which is the rotation speed of the fur brush 102 during the rotation drive of the image bearing member. With this, a lubricant, which is likely to adhere to the intermediate transfer belt 51, in the nip portion between the fur brush 102 and the image bearing member can be scraped strongly, leading to reduction in time.

Figure 3:
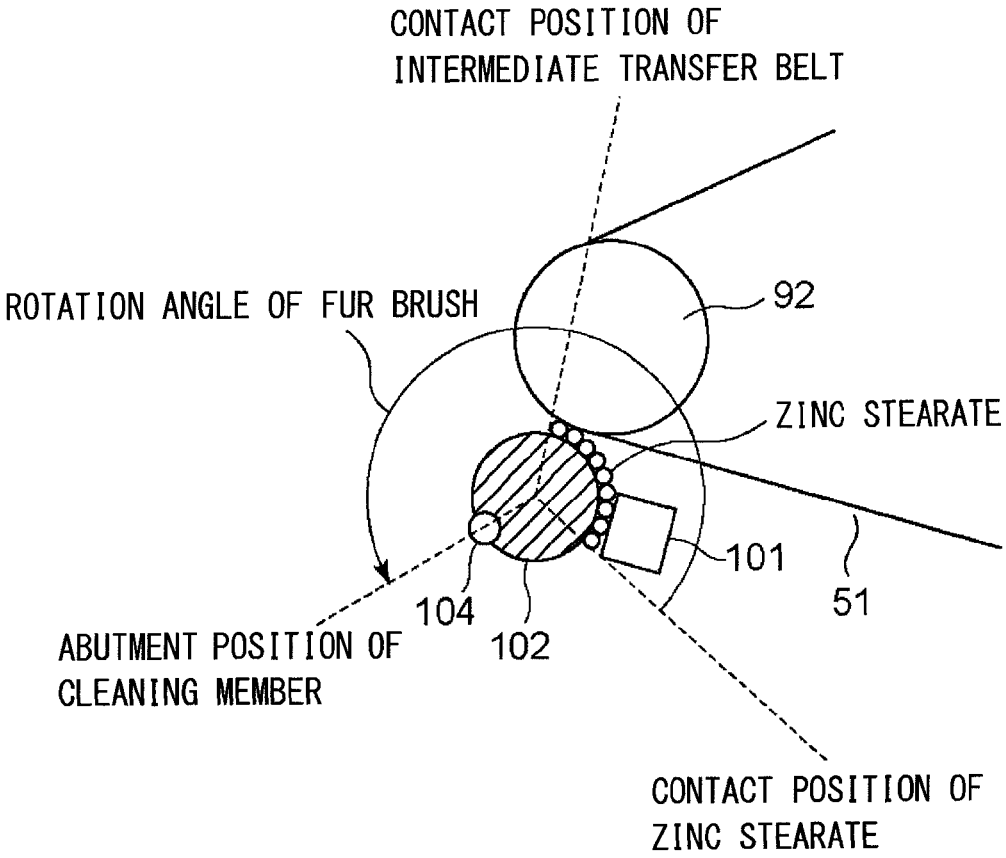
FIG. 3 is a view illustrating a rotation angle of the fur brush at the start of image formation according to the first embodiment.

The rotation angle of the fur brush 102 at the start of image formation in this embodiment will be described. The fur brush 102 is rotated for a predetermined period of time before the rotation drive of the intermediate transfer belt 51. FIG. 3 illustrates the rotation angle at this time.

As illustrated in FIG. 3, in this embodiment, after the fur brush 102 is rotated by a rotation angle from the contact position of zinc stearate to the abutment position of the cleaning member, the intermediate transfer belt 51 is driven to rotate. The rotation of the fur brush 102 is started from the state in which the fur brush 102 is suspended while holding zinc stearate. In this embodiment, zinc stearate held by the fur brush 102 is collected by the cleaning member 104. Thus, solid zinc stearate held on the surface of the fur brush 102 can be cleaned. The cleaning member 104 is positioned on a downstream side in the rotation direction with respect to the contact position of the intermediate transfer belt 51 and on an upstream side in the rotation direction with respect to the contact position of the zinc stearate 101.

That is, the present invention has a feature that, after the fur brush 102 is driven to rotate from an angle of the contact position of the zinc stearate to an angle of the start of the abutment position of the cleaning member, the rotation drive of the intermediate transfer belt 51 is started. Through rotation drive of only the fur brush 102 while the intermediate transfer belt 51 is suspended, the fur brush 102 can scrape zinc stearate held at a point where the fur brush 102 and the intermediate transfer belt 51 are in abutment. Thus, zinc stearate pressed against the intermediate transfer belt 51 by the fur brush 102 for a long period of time is collected by the fur brush 102. Therefore, even when the rotation drive of the intermediate transfer belt 51 is started, the intermediate transfer belt is not driven to rotate with zinc stearate adhering thereto, and the adhering zinc stearate is not supplied to the cleaning blade 103.

Further, after 0.5 seconds from the start of the rotation drive of the intermediate transfer belt 51, at which the rotation drive becomes stable, the charging high voltage is turned on to charge the surface of the photosensitive drum uniformly, and the development high voltage and the primary transfer high voltage are turned on to form an image.

In this embodiment, a lubricant is applied to the intermediate transfer member. However, a lubricant may be applied to the photosensitive drum 1. In this configuration, after the lubricant applying unit is rotated, the drive of the photosensitive drum is started.

Further, the rotation angle of the lubricant applying unit at the start of image formation is not limited to the rotation angle from the contact position of zinc stearate to the abutment position of the cleaning member. The drive of the image bearing member may be started after the lubricant applying unit is rotated by an angle equal to or more than the rotation angle or by an angle less than the rotation angle. Alternatively, the rotation of the intermediate transfer belt 51 may be started after the contact position of zinc stearate passes by at least the abutment position between the fur brush 102 and the intermediate transfer belt 51.

Second Embodiment

Figure 4:
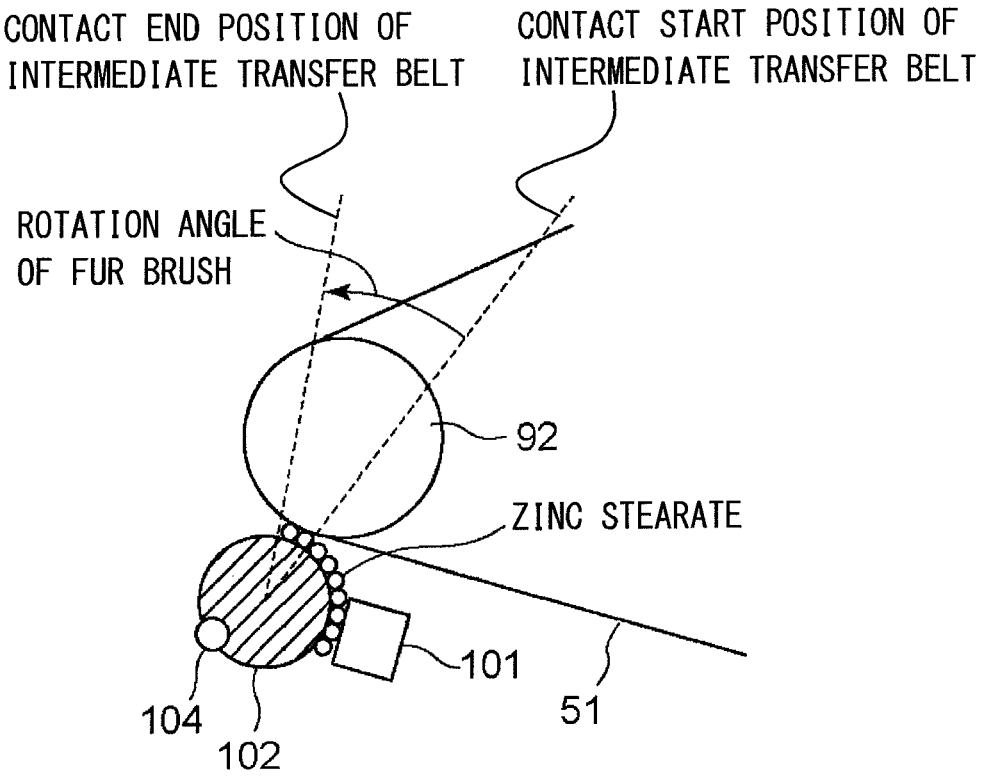
FIG. 4 is a view illustrating a rotation angle of a fur brush at the start of image formation according to a second embodiment of the present invention.

In a second embodiment of the present invention, the configurations of the image forming apparatus and the fur brush are the same as those of the first embodiment, and hence the descriptions of the same portions are omitted. The feature of this embodiment is as follows. As illustrated in FIG. 4, after the fur brush 102 is driven to rotate from the contact start position between the fur brush 102 and the intermediate transfer belt 51 to the contact end position, the rotation drive of the intermediate transfer belt 51 is started. Specifically, after the fur brush 102 is rotated by an angle equal to or more than the contact angle between the fur brush 102 and the image bearing member, the image bearing member is rotated.

With this, the intermediate transfer belt 51 can be driven after zinc stearate powder pressed between the fur brush 102 and the intermediate transfer belt 51 is scraped by the fur brush 102. Therefore, zinc stearate pressed at the contact position between the fur brush 102 and the intermediate transfer belt 51 can be prevented from adhering to the intermediate transfer belt 51.

Further, compared with the operation as in the first embodiment, in which the rotation of the intermediate transfer belt 51 is started after the fur brush 102 is rotated from the contact position of the zinc stearate for application, to the abutment position of the cleaning member 104, the rotation angle of the fur brush 102 can be decreased. Thus, a time period required for image formation operation of the image forming apparatus can be shortened, and a first copy output time can be shortened.

Also in this embodiment, it is possible to prevent the surface of the image bearing member from being scratched and the cleaning blade 103 from being turned up or chipped, which are caused by adhesion of the lubricant to the surface of the image bearing member.

(Others)

In the first and second embodiments, a mode of driving the fur brush 102 to rotate in synchronized timing with the start of image formation, and then, starting the rotation drive of the intermediate transfer belt 51 is performed for every image formation. However, the present invention is not limited thereto. For example, a lubricant is likely to adhere at a later stage in use for image formation, and hence it may be determined whether or not the above-mentioned mode is performed depending upon the number of sheets on which an image is to be formed and durability. For example, at an initial stage in use for image formation, along with the start of image formation, a speed priority mode of starting the rotation drive of the intermediate transfer belt 51 without waiting for the rotation of the fur brush 102 is performed so as to prevent downtime. On the other hand, at the later stage in use for image formation (in the case where images are formed on a predetermined number of sheets or more) at which a lubricant is likely to adhere, the mode may be switched to an image quality priority mode of starting the rotation drive of the intermediate transfer belt 51 after the fur brush 102 is driven to rotate. Further, the speed priority mode or the image quality priority mode may be selected through use of a timer based on an elapsed time from the previous image formation end. That is, control may be performed so that, only in the case where a predetermined period of time or more has elapsed from the previous image formation end, the image quality priority mode is performed, and otherwise, the speed priority mode is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-130261, filed Jun. 10, 2011, which is hereby incorporated by reference herein in its entirety.

What is claimed is:

1. An image forming apparatus, comprising:

a rotatable image bearing member;

a blade member which is in abutting contact with the image bearing member and removes a remaining toner remaining on the image bearing member;

a rotary member which is rotatably provided in contact with the image bearing member on an upstream side with respect to the blade member in a rotation direction of the image bearing member;

a lubricating member which is brought into abutting contact with the rotary member to supply a lubricant to the rotary member;

first drive means configured to drive the image bearing member;

second drive means configured to drive the rotary member; and an execution portion configured to execute a mode of controlling the drive of the first drive means and the second drive means so that the rotary member starts to rotate based on an image formation start signal, a contact portion of the rotary member, which is in contact with the lubricating member when the rotary member is stopped, passes a contact position in which the image bearing member and the rotary member come into contact with each other, and thereafter, the image bearing member starts to rotate.

2. An image forming apparatus according to claim 1, wherein the lubricating member comprises solid zinc stearate, and the rotary member comprises a fur brush that comes into abutting contact with the image bearing member.

3. An image forming apparatus according to claim 1, wherein the image bearing member comprises an intermediate transfer member onto which a toner image on a photosensitive member is transferred; and the image bearing member comprises at least an elastic layer.

4. An image forming apparatus according to claim 1, wherein the execution portion selectively executes the mode based on a number of sheets on which images have been formed or an elapsed time from a previous image formation end.

* * * * *